US011448426B2

(12) United States Patent
Nishida et al.

(10) Patent No.: US 11,448,426 B2
(45) Date of Patent: Sep. 20, 2022

(54) COOLING SYSTEM

(71) Applicant: WACON KABUSHIKIKAISYA, Kinokawashi Wakayama (JP)

(72) Inventors: Kohei Nishida, Kinokawashi (JP); Hitoshi Fujino, Kinokawashi (JP); Takeshi Kawaguchi, Otashi (JP); Hideo Uehara, Otashi (JP); Masaaki Mike, Wakayamashi (JP)

(73) Assignee: WACON KABUSHIKI KAISHA, Kinokawashi Wakayama (JP)

( * ) Notice: Subject to any disclaimer, the term of this patent is extended or adjusted under 35 U.S.C. 154(b) by 98 days.

(21) Appl. No.: 16/960,300

(22) PCT Filed: Dec. 26, 2018

(86) PCT No.: PCT/JP2018/047813
§ 371 (c)(1),
(2) Date: Sep. 24, 2020

(87) PCT Pub. No.: WO2019/135378
PCT Pub. Date: Jul. 11, 2019

(65) Prior Publication Data

US 2021/0018245 A1 Jan. 21, 2021

(30) Foreign Application Priority Data

Jan. 5, 2018 (JP) ..... JP2018-000828
Nov. 26, 2018 (JP) ..... JP2018-220004

(51) Int. Cl.
*F25B 1/00* (2006.01)
*F25D 11/00* (2006.01)
(Continued)

(52) U.S. Cl.
CPC ..... *F25B 1/005* (2013.01); *F25B 41/39* (2021.01); *F25D 11/003* (2013.01); *F25D 19/003* (2013.01); *F25D 2700/12* (2013.01)

(58) Field of Classification Search
CPC .. F25D 11/003; F25D 2700/12; F25D 19/003; F24F 1/04; F25B 41/31; F25B 2339/0441
See application file for complete search history.

(56) References Cited

U.S. PATENT DOCUMENTS

2012/0085123 A1 4/2012 Wasnievski da Silva et al.
2016/0252288 A1* 9/2016 Lee ..... F25B 5/02 62/216

(Continued)

FOREIGN PATENT DOCUMENTS

JP S4853646 U 7/1973
JP S4962243 U 5/1974

(Continued)

OTHER PUBLICATIONS

Translation JP 59084386.*

(Continued)

*Primary Examiner* — Elizabeth J Martin
(74) *Attorney, Agent, or Firm* — Millen, White, Zelano & Branigan, P.C.; William Nixon

(57) ABSTRACT

A cooling system is configured for arranging a cooling machine and a heat exchanger, for example, inside and outside a heat insulation box. A cooling unit for discharging cooled air by heat exchange using a refrigerant and a heat exchange unit for returning the refrigerant to a coolable condition are connected by a connection portion connecting the upper portions to form an integrated cooling device. The connection portion is arranged so as to straddle an end of a sidewall of the heat insulation box, the cooling unit is arranged inside the heat insulation box, and the heat exchange unit is arranged outside the heat insulation box.

(Continued)

During storage or movement by a delivery vehicle, the cooling device is mounted on the heat insulation box. When carrying with hand, only the heat insulation box from which the cooling device is removed can be carried.

7 Claims, 12 Drawing Sheets

(51) Int. Cl.
*F25D 19/00* (2006.01)
*F25B 41/39* (2021.01)

(56) References Cited

U.S. PATENT DOCUMENTS

| | | | | |
|---|---|---|---|---|
| 2019/0128589 | A1* | 5/2019 | Adams | F25D 17/06 |
| 2020/0217521 | A1* | 7/2020 | Lundstrom | F24F 1/0003 |

FOREIGN PATENT DOCUMENTS

| | | | |
|---|---|---|---|
| JP | S5413056 | U | 1/1979 |
| JP | S5615969 | U | 2/1981 |
| JP | 59084386 | * | 6/1984 |
| JP | S5984386 | U | 6/1984 |
| JP | 08-200890 | A | 8/1996 |
| JP | 08-313136 | A | 11/1996 |
| JP | 09-324964 | A | 12/1997 |
| JP | 10-220924 | A | 8/1998 |
| JP | 11-118294 | A | 4/1999 |
| JP | 2004-101033 | A | 4/2004 |
| JP | 2017150700 | A | 8/2017 |

OTHER PUBLICATIONS

English Translation of International Search Report for PCT/JP2018/047813 dated Mar. 19, 2019.
English Abstract for JPH08313136, Publication Date: Nov. 29, 1996.
English Abstract of JP2017150700, Publication Date: Aug. 31, 2017.
English Abstract of JP10-220924, Publication Date: Aug. 21, 1998.
English Abstract of JP09-324964, Publication Date: Dec. 16, 1997.
English Abstract of JP2004101033, Publication Date: Apr. 2, 2004.
English Abstract of JPH11118294, Publication Date: Apr. 30, 1999.
English Abstract of JPH08200890, Publication Date: Aug. 6, 1996.

* cited by examiner

COOLING SYSTEM

TECHNICAL FIELD

The present invention relates to a cooling system. The present invention also relates to a clogging prevention mechanism for a capillary tube in a refrigeration cycle used for the cooling system.

BACKGROUND ART

As a heat insulation box applicable to a cold chain that conveys an item to be transported from an upstream end of physical distribution to a downstream end thereof while maintaining it in a low-temperature range within a predetermined temperature range, for example, as disclosed in Patent Document 1, it is known that a cooling unit is attached to a heat insulation box.

In Patent Document 2, it is proposed that a heat insulation box for transporting and holding a stored item while storing in a low-temperature state, a refrigerator for holding the inside of the heat insulation box at a low-temperature, and a measuring means for measuring the internal temperature of the heat insulation box over time are provided, a refrigerator is provided on the upper surface of the heat insulation box, and a regenerative coolant accommodation case for accommodating a regenerative coolant cooled by a cooled air of the refrigerator is provided on the rear surface of the heat insulation box.

In Patent Document 3, a cooling device is disclosed in which a heat insulation box including a sealable cooling chamber and a cooling device composed of a Stirling refrigerator for cooling the inside of the cooling chamber. In this Patent Document 3, Claim 2 and paragraph 0045 of the specification describe that a lid may be detachable from a box body via a hinge mechanism, which is convenient because the lid can be removed from the box body to wash the entire box body. Further, in Patent Document 3, it is described in Claim 7 and the paragraph [0051] of the specification that the cooling device may be detachable from the box body and efficient cooling can be performed by mounting the cooling device suitable for a temperature zone required for an item to be cooled. However, it is silent about the specific structure thereof.

Patent Document 4 illustrates an example of a general cooling system, but in a general cooling system, an annealed copper pipe is used for that piping. It is assumed that the piping shown in Patent Document 4 is soft, but in the structure that stresses are concentrated on the piping during attachment and detachment, there is a drawback that the piping is likely to be bent or broken.

On the other hand, in a general cooling device, such as, e.g., a refrigerator and a freezer, as disclosed in Patent Documents 1 to 4, etc., a refrigeration cycle in which a refrigerant gas is enclosed is used, wherein the refrigeration cycle is configured by a compressor, a condenser, a capillary tube, and an evaporator as main elements. If a problem occurs in this device, a food, etc., accommodated in the box is rotten or dissolved, which causes damage. Therefore, reliability with less break down is required.

Refrigerating machine oil is circulated in the piping of the refrigeration cycle for lubricating the mechanisms in the compressor in addition to a refrigerant such as freon. The refrigerating machine oil is exposed to a high temperature and high pressure in the process of the compression, and metal fine powder is mixed in and denatured into tar-like oil sludge and adheres to the inner wall near the inlet of the capillary tube where the pressure drops rapidly and the flow rate increases.

Specifically, as shown in the image diagram of FIG. 12 of this application, the flow rate of the high-temperature and high-pressure liquid refrigerant in the filter dryer 104 is rapidly increased at the inlet of the inflow end of the capillary tube 105 and reduced in pressure, so that the oil sludge S adheres to the inner wall of the capillary tube 105 in the vicinity of the inlet. FIG. 12(A) shows an initial state, FIG. 12(B) shows a state in which oil sludge S is adhered to a certain extent over time, and FIG. 12(C) shows a state in which the capillary tube 105 is clogged by oil sludge S over time and the refrigerant cannot be further circulated.

In particular, in a relatively small refrigeration cycle (specifically, a refrigeration cycle with a compressor power of 500 W or less), since the inner diameter of the capillary tube is generally as small as φ0.5 mm to 1.2 mm, there occur many problems that the adhered amount increases with the operation time, finally resulting in a clogged state, which cannot perform cooling.

Since a capillary tube is a mechanism for generating a pressure difference by giving resistance to a flow of a fluid (refrigerant), the inner diameter and the length (typically several 10 cm to several meters) are factors of the resistance. If a resistor of the same degree can be given, the smaller the inner diameter, the shorter the length can be, which is advantageous in terms of cost reduction and space-saving.

However, as described above, since there occurs clogging of the capillary tube by oil sludge mainly in the inflow end, there has been a problem that it is not possible to use a capillary tube with a small inner diameter above a certain level. The present invention aims to improve the durability and the reliability of a small-sized refrigerator or freezer by providing a mechanism that prevents cooling failures due to clogging by oil sludge even if a capillary tube with a small inner diameter is selected.

As an improvement on a diameter of a capillary tube, the invention described in Patent Document 1 has been proposed. According to the invention described in Patent Document 1, in an air conditioner configured to circulate a refrigerant in a refrigerant circuit in which refrigerant tubes are connected to a compressor, a condenser, a capillary tube, and an evaporator, it is characterized in that at the connection portion between the refrigerant tube and the capillary tube, the inner diameter of the refrigerant tube is gradually reduced to the inner diameter of the capillary tube.

The invention of Patent Document 5 relates to a mechanism for suppressing clogging of a capillary tube due to oil sludge as described in the specification paragraph [0005], "Conventionally, at the connection portion between a refrigerant tube and a capillary tube, the inner diameter of the tube is sharply reduced, and at the end of the capillary tube, due to such a sudden change, it becomes suddenly a high pressure and a high temperature, causing adhesion of sludge such as metals to narrow or clog the inlet of the capillary tube". The cause of the adhesion of the oil sludge is considered to be a rapid change in the diameter of the tube.

Accordingly, the solution was to prevent adhesion of oil sludge by gradually reducing the inner diameter of the refrigerant tube to the inner diameter of the capillary tube at the connection portion between the refrigerant tube and the capillary tube to prevent the refrigerant from suddenly becoming a high pressure and a high temperature.

More specifically, as shown in FIG. 4 of Patent Document 5, at the connection portion between the refrigerant tube and the capillary tube, when the inner diameter of the refrigerant tube is D, the inner diameter of the capillary tube is d, and the length of the connection portion at which the inner diameter of the refrigerant tube is gently reduced from D to d is L, it is concluded that it is appropriate to satisfy the relationship L>D.

Further, at the connection portion between the refrigerant tube and the capillary tube, when the inner diameter of the refrigerant tube is D, the inner diameter of the capillary tube is d, and the length of the connection portion in which the diameter of the refrigerant tube is gradually decreased is L, it is concluded that it is appropriate to satisfy the relationship L/D<30.

PRIOR ART DOCUMENT

Patent Document

Patent Document 1: International Publication No. WO 2016/114297 Pamphlet

Patent Document 2: U.S. Pat. No. 3,802,976

Patent Document 3: Japanese Unexamined Patent Application Publication No. 2001-311576

Patent Document 4: Japanese Unexamined Patent Application Publication No. 11-304347

Patent Document 5: Japanese Unexamined Patent Application Publication No. 9-79700

SUMMARY OF THE INVENTION

Problems to be Solved by the Invention

In physical distribution of a cold chain, an item to be transported is transported from its upstream end to its downstream end while maintaining a specified temperature range, and its operation is performed by a special vehicle, such as, e.g., a refrigerator vehicle and a freezer vehicle. However, in an ordinary delivery vehicle, a mixed physical distribution using a cooling box is often performed. Automation and temperature-control equipment for it are being developed, at the downstream end of the distribution, an item to be transported is transported by a human hand to complete the physical distribution. On the other hand, the workplace involved in the physical distribution industry is one of workplaces where the imbalance between the improvement of various services and qualities required for the physical distribution and the labor force to cope with it comes up in the surface. As a workplace where the problems of labor issues in Japan can be said to have been concentrated, improvements in the working conditions are urgently and strongly required.

In each proposal of the above-described Patent Documents, although they are proposals from the viewpoint of services and qualities of items to be transported, it should be said that they are lacking in the viewpoint of improving working conditions. For example, in Patent Document 3, as described above, it merely teaches that a lid is detachably attached to a box body via a hinge mechanism so that the entire box body can be washed by removing the lid from the box body, or merely teaches that a cooling device suitable for a temperature zone required for an item to be transported is detachably attached to the box body, thereby enabling efficient cooling. Therefore, there is no viewpoint from improving working conditions.

An object of the present invention is to provide a cooling system having a configuration advantageous for arranging, for example, a cooling machine and a heat exchanger inside and outside a heat insulation box, respectively, and also to provide a cold transportation means in the cooling system.

The present invention aims to provide a cooling unit provided with a structure capable of being arranged in a heat insulation box without providing a large opening in the heat insulation box and advantageous for attaching to and detaching from the heat insulation box.

In particular, the present invention aims to provide a cooling system capable of improving insulation performance by minimizing an opening by providing piping in a connection plate that connects a cooling unit and a heat discharge unit to enable sealed insulation and also capable of performing attachment and detachment with respect to a heat insulation box without using tools while preventing a direct stress concentration on piping. Furthermore, the present invention aims to provide a cooling system suitable for low-temperature transportation in which on an outward route for transporting an item to be kept cold, the cooling system can be mounted on a heat insulation box so that the temperature control can be performed at easy; on the other hand, on the return route, the cooling system can be removed, so that the heat insulation box can be used as a normal heat insulation box or the transportable space can be secured by folding up the heat insulation box.

The present invention aims to provide a cooling system capable of solving the issues from the viewpoint of friendliness to people, such as improving working conditions of actual people who handles items to be transported and the issues from the viewpoint of temperature maintenance of an item to be transported.

The present invention also aims to provide a cooling system equipped with a refrigeration cycle capable of suppressing sludge adhesion to a main capillary tube by providing a sub-capillary tube with a large inner diameter and a short length on an inlet side of a main capillary tube to make oil sludge sacrificially adhere to an inlet side of a sub-capillary tube with a large inner diameter so as not to feed the oil sludge to the downstream side, thus functioning as a so-called filter. In other words, the present invention aims to provide a clogging prevention mechanism of a capillary tube in a cooling system.

Means for Solving the Problem

The present invention provides a cooling system including: a heat insulation box with a lid for low-temperature transportation: and a cooling device, wherein the cooling device is provided with a cooling unit arranged inside the heat insulation box with the lid and a heat exchange unit arranged outside the heat insulation box with the lid, wherein a connection portion connecting the cooling unit and the heat exchange unit is sandwiched between the lid and a heat insulation box body of the heat insulation box with the lid, and wherein a refrigerant is configured to circulate between the cooling unit and the heat exchange unit via the connection portion to cool an inside of the heat insulation box with the lid.

Note that in the present invention, the upper, lower, left, and right merely indicate relative positional relationships, and do not specify absolute positions.

The cooling unit according to the present invention can be implemented by configuring as follows. The cooling unit and the heat exchange unit are connected by the connection portion, the cooling unit includes a temperature sensor for detecting a temperature in the box and a fan motor for sending a cooled air for cooling into the box, the connection portion is composed of a connection plate in which piping for the refrigerant and wiring of a temperature sensor and a fan motor are laid therein, and the heat exchange unit and the connection portion are detachable with respect to the heat insulation box When it is considered that the cooling device and the heat exchanger are integrated as a single cooling device and the single cooling device is mounted on a heat insulation box, it is possible to adopt a structure in which only the cooled air discharging section of the cooling device is arranged in the heat insulation box. However, in the structure, a large through-hole must be provided in the heat insulation box, which results in reduced cooling performance of the heat insulation box. On the other hand, in the present invention, it is configured such that the refrigerant circulates between the cooling unit and the heat exchange unit through the connection portion. Therefore, the heat insulating performance can be greatly improved by reducing the penetration part provided in the heat insulation box. Further, by configuring such that the connection portion is arranged so as to straddle the end portion of the sidewall of the heat insulation box, it is advantageous in terms of manufacturing costs in that the structure of the heat insulation box can be simplified. In addition, it is also advantageous in that it is easily configured so that the detachment can be easily performed when the cooling device is configured to be detachable from the heat insulation box.

It is also preferable to configure such that the cooling device and the heat insulation box with a lid can be attached and detached without using a tool. Considering the convenience of attachment and detachment, it is more preferable to configure such that the detachment can be easily performed without loosening screws or the like using a special tool or the like. On the other hand, for the sake of securing the attachment reliability, it may be configured to be a temporarily fixable configuration by a fastening tool, such as, e.g., a clip-shaped fastening tool and a screw.

The heat insulation box with a lid may be implemented as provided with a box body including a plurality of sidewalls constituting a storage space and a lid arranged on the opening surface of the box body to close the heat insulation box. In this case, it is also preferable that a communication recess is provided on at least one of the sidewall and the lid so that the lid can close the box body without a gap in a state in which the connection portion is accommodated in the recess. Specifically, the heat insulation box with a lid may be implemented such that the connection portion is fitted in the recess without a gap (more preferably, the connection portion and the periphery of the recess are fitted in contact with each other) so that a large quantity of cooled air does not leak out of the heat insulation box, or such that a gap is formed between the connection portion and the recess, but at least one of the cooling device and the heat insulation box is in contact with the box body so that a large quantity of cooled air does not leak out of the heat insulation box.

In particular, a heat insulation box with a lid can secure a surprising insulation performance by embedding a vacuum-insulated panel inside thereof, thereby saving energy, and has been used for transporting valuable pharmaceuticals, reagents, etc., while maintaining temperature with high precision. However, it is difficult to maintain the insulation performance when a cooling system is installed by drilling a through-hole in a conventional sidewall, making it difficult to save energy. In the present invention, it is possible to realize a cooling system with a simple and low-cost structure in which a recessed portion for placing a connection portion is provided at the upper end portion of the vacuum heat insulation box or at the lower surface portion of the lid, and to secure high-quality temperature management.

The present invention provides a low-temperature transportation system characterized in that the above-described cooling system is arranged on a cargo bed of a delivery vehicle for physical distribution to perform cooling by the cooling unit during the delivery movement, and when an item to be transported is carried to the outside of the vehicle, the cooling device equipped with the cooling unit, the heat exchange unit, and the connection portion is removed so that only the heat insulation box with a lid and the item to be transported can be transported lightly.

According to this system, an item to be transported can be transported to a first destination without carrying a heavy cooling device by a person while maintaining the cooling condition. Therefore, it is possible to provide a low-temperature transportation system capable of solving both of the problems from the viewpoint of friendliness to people, such as improving the working condition of actual people handling an item to be transported and the problems from the viewpoint of temperature maintenance of an item to be transported.

Further, the present invention provides a clogging prevention mechanism of a capillary tube characterized in that a sub-capillary tube having an inner diameter larger than that of a capillary tube is arranged between a filter dryer and the capillary tube in a refrigeration cycle.

It has been found by the inventors that when the inner diameter SD of the inflow end of the sub-capillary tube is larger than the inner diameter CD of the inflow end of the capillary tube, in particular, when the following condition is satisfied, it is possible to effectively suppress sludge adhesion of the main capillary tube. Based on this finding, the present invention has been completed.

The standard inner diameter FD of a filter dryer is 15 mm to 30 mm.

The inner diameter CD of the inflow end of the capillary tube is 0.5 mm to 1.2 mm.

The inner diameter SD of the inflow end of the sub-capillary tube is larger than 0.7 mm.

The inventive concept of the present invention is to cause oil sludge to sacrificially adhere to the inlet side of the sub-capillary tube having a large inner diameter by installing a sub-capillary tube having a large inner diameter and a short length on the inlet side of the main capillary tube. Therefore, as described in Patent Document 5, it is not necessarily required to gradually reduce the diameter of the refrigerant tube to the diameter of the capillary tube at the connection portion of the capillary tube in order to prevent the adhesion of the oil sludge by preventing the refrigerant from rapidly becoming high pressure and high temperature.

Therefore, in implementing the present invention, it is possible to adopt the filter dryer provided with the body portion, a connection portion for connecting the sub-capillary tube, and a reduced diameter portion ranging from the outflow end of the body portion of the filter dryer to the reduced diameter portion of the connection portion. When the length of the reduced diameter portion is L, it can be implemented as a relationship of $L<2FD$, or as a relationship of $L<FD$.

Effects of the Invention

The present invention can provide a cooling system characterized in that piping is laid in the connection plate connecting the cooling unit and the heat exchange unit, so that it becomes possible to attain sealing and thermal insulation, prevent stress from being directly applied to the piping, and enable mounting/dismounting to/from the heat insulation box without using a tool or the like.

Further, the present invention can provide a cooling system in which it is possible to perform temperature management at easy by attaching the cooling system to the heat insulation box on the outward route for transporting an item to be cooled, while on the return route, the cooling system can be removed, so that it can be used as a normal heat insulation box, and it becomes suitable for low-temperature transportation by folding up the heat insulation box to secure a transportation space.

The present invention can provide a heat insulation box with a cooling unit in which the cooling device can be mounted on the heat insulation box without providing a large opening in the heat insulation box by arranging the connection portion so as to straddle the end portion of the sidewall of the heat insulation box.

Further, the present invention can provide a cooling system capable of completing attachment/detachment by a simple handling procedure by configuring so that it can be attached and detached without using a tool, such that the attachment can be completed by arranging the connection portion so as to straddle the end portion of the sidewall of the heat insulation box in a state in which the cooling unit is arranged inside the heat insulation box and the heat exchange unit is arranged outside the heat insulation box, and the detachment can be completed simply by pulling out the cooling device from the heat insulation box.

The present invention can provide a cooling system suitable for low-temperature transportation capable of solving both the problems from the viewpoint of human friendliness, such as improving the working conditions of the actual people handling an item to be transported and the problems from the viewpoint of temperature maintenance of an item to be transported.

The present invention can provide a cooling system equipped with a refrigeration cycle in which sludge adhesion on a main capillary tube is suppressed by installing a sub-capillary tube having a large inner diameter and a short length on the inlet side of the main capillary tube, so that oil sludge is sacrificially adhered to the inlet side of the sub-capillary tube having a large inner diameter to prevent oil sludge from being sent to the downstream side, thereby functioning as a so-called filter. In other words, it is possible to provide a clogging prevention mechanism of a capillary tube in a cooling system equipped with a refrigeration cycle.

EMBODIMENTS FOR CARRYING OUT THE INVENTION

Figure 1:
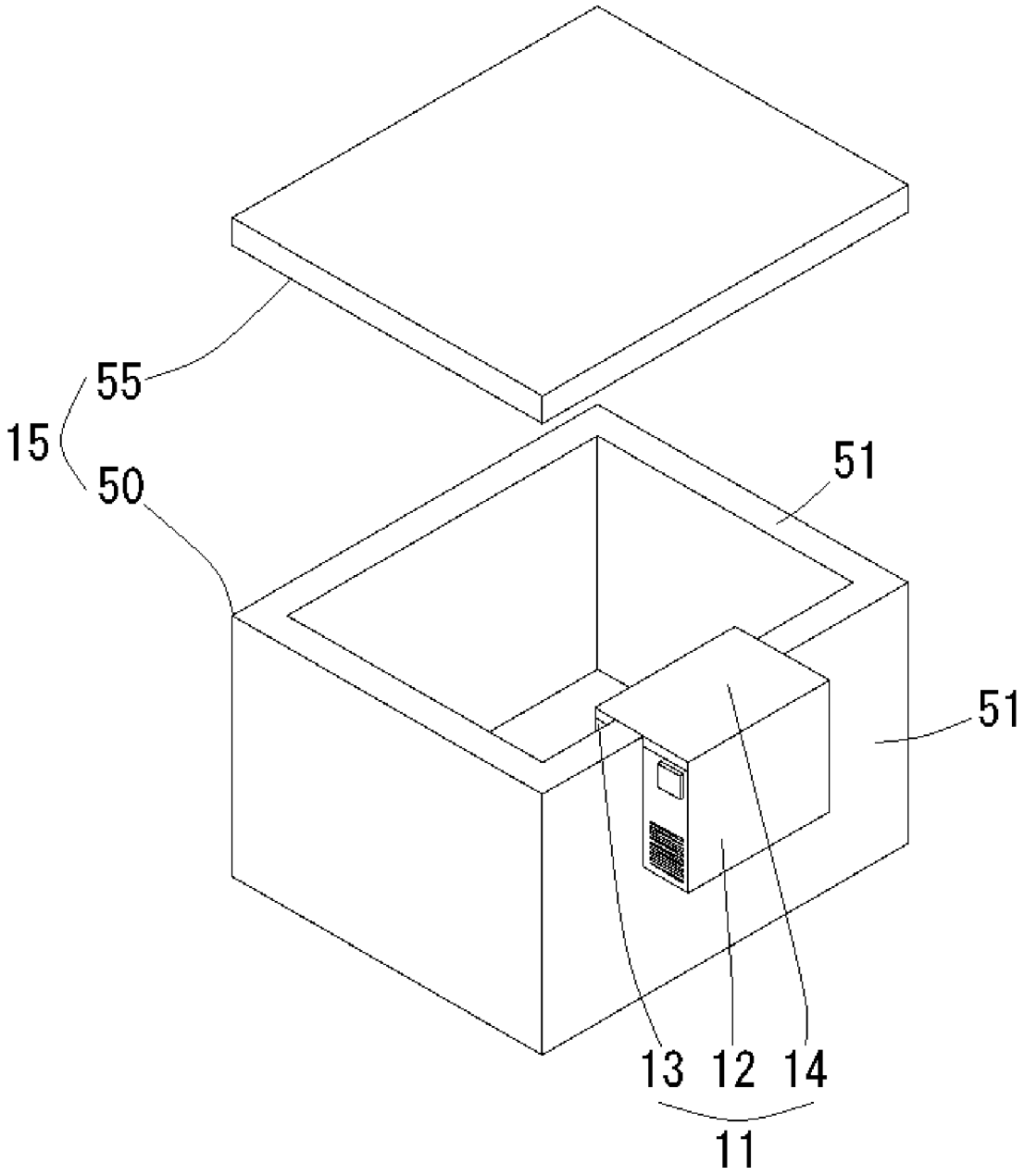
FIG. 1 is a perspective view of a cooling system according to an embodiment of the present invention.

Hereinafter, embodiments of the present invention will be described with reference to the attached drawings.

Overview of Cooling Device 11

A cooling system according to this embodiment is a system equipped with a cooling device 11 in which a cooling unit 13 and a heat exchange unit 12 are integrally connected by a connection portion 14, and a heat insulation box 15 to which the cooling device 11 is attached. This system can be applied to transportation at a low-temperature.

The cooling device 11 is, as shown in FIG. 1, a cooling device represented by a compressor refrigerator, and the cooling unit 13 and the heat exchange unit 12 are integrally connected by a connection portion 14. The cooling unit 13 is configured to discharge cooled air by heat exchange using a refrigerant to cool the inside of the heat insulation box 15 to a predetermined temperature. The heat exchange unit 12 is configured to cool the refrigerant by exchanging heat with the outside air. The cooled refrigerant is sent to the heat exchange unit 12 via the connection portion 14. The connection portion 14 connects the upper portion of the heat exchange unit 12 and that of the cooling unit 13, and is accommodating refrigerant conduits 41 and electrical wires 42 (see FIG. 5 and FIG. 6) therein to circulate the refrigerant between the heat exchange unit 12 and the cooling unit 13.

Heat Exchange Unit 12 and Cooling Unit 13

Figure 5:
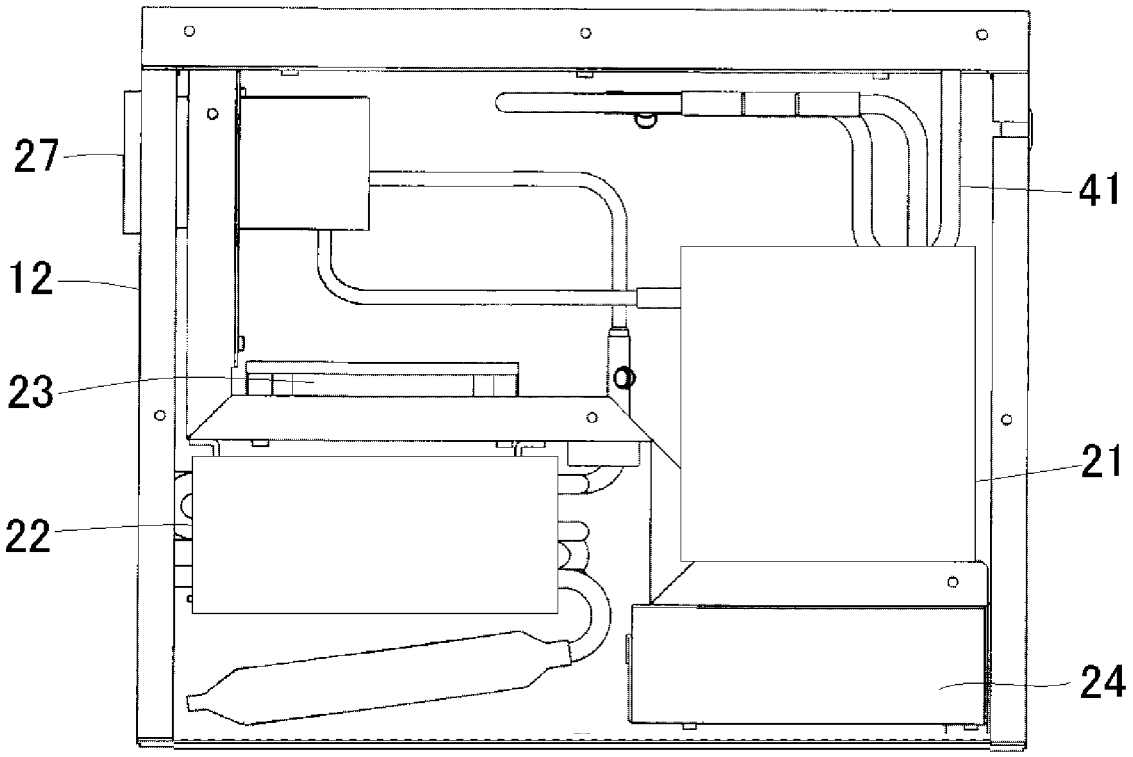
FIG. 5 is an explanatory diagram of an inner structure of a heat exchange unit of the cooling system.
Figure 6:
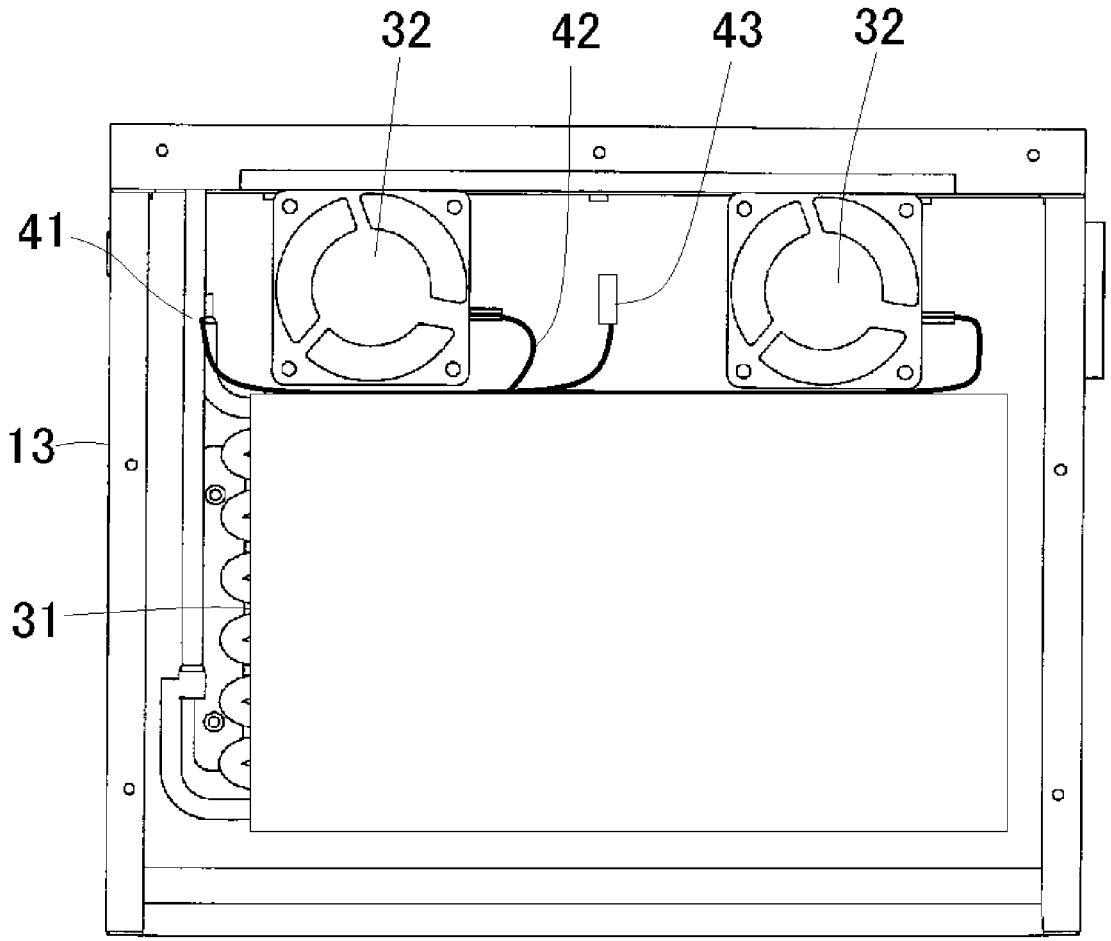
FIG. 6 is an explanatory diagram of an inner structure of the cooling unit of the cooling system.
Figure 7:
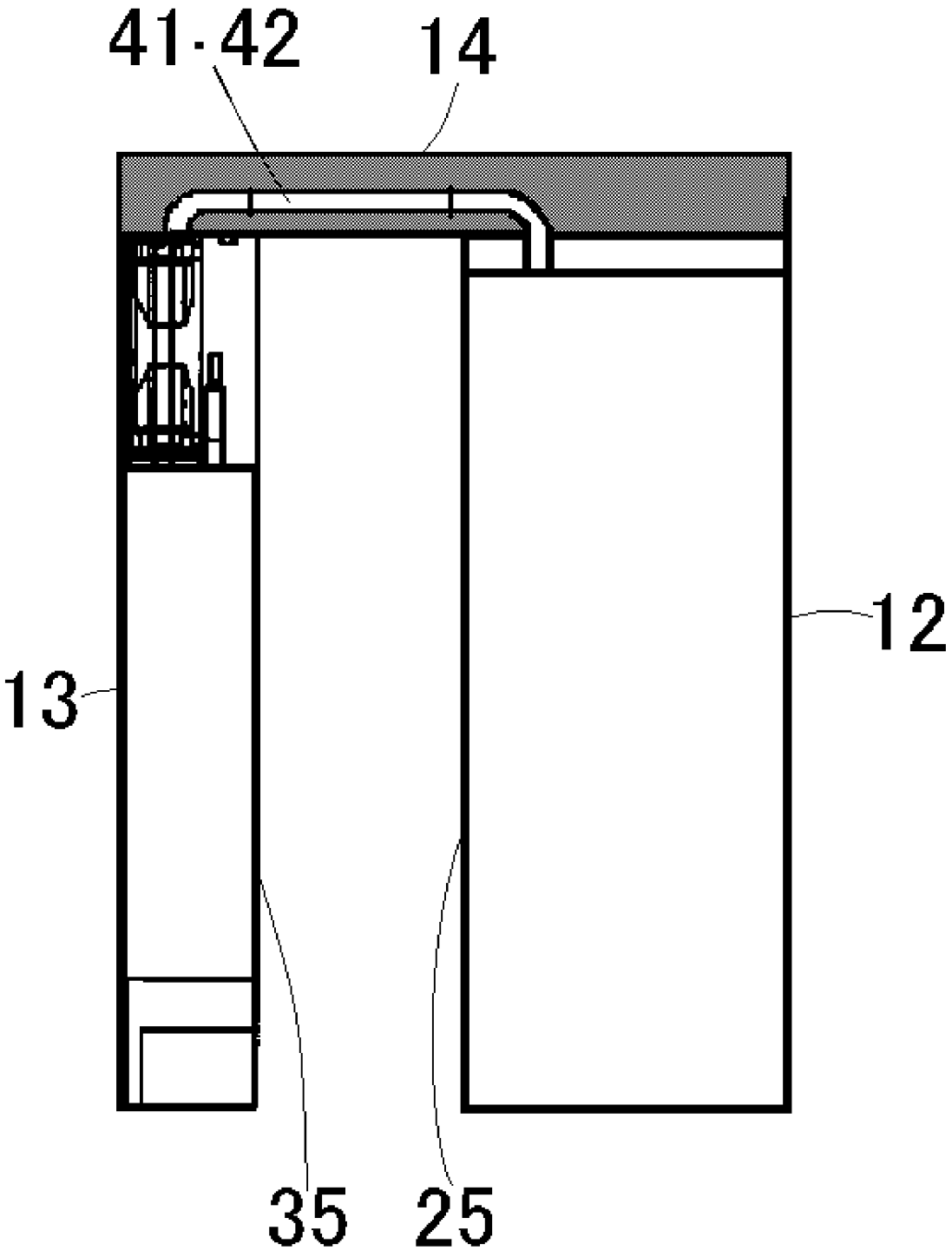
FIG. 7 is an inner structure explanatory diagram of a cooling device of the cooling system.

The heat exchange unit 12 and the cooling unit 13 constitute a cooling system used in conventional various refrigerators. As shown in FIG. 5, the heat exchange unit 12 is provided with, as its main configuration, a compressor 21, a condenser 22, a condensing fan 23, and a power supply device 24. As shown in FIG. 6, the cooling unit 13 is provided with, as its main configuration, an evaporator 31, cooling fans 32, an expansion valve (not shown), and a temperature sensor 43.

The operating conditions of the heat exchange unit 12 and the cooling unit 13 are the same as those of a conventional cooling system, but will be briefly described.

First, a refrigerant compressed by the compressor 21 of the heat exchange unit 12 is introduced into the condenser 22. The refrigerant is cooled and liquefied by the air of the condensing fan 23 at the condenser 22.

The liquefied refrigerant is sent to the cooling unit 13 through a capillary tube provided along a refrigerant conduit 41 arranged in the connection portion 14. Note that the capillary tube will be described later in detail by referring to FIG. 9 to FIG. 12.

In the cooling unit 13, the liquefied refrigerant is injected into the evaporator 31 to be vaporized. The vaporized refrigerant draws the heat around the evaporator 31, thereby cooling the evaporator 31. The wind from the cooling fan 32 passes through the cooled evaporator 31 to become cooled air and flows into the heat insulation box 15 to thereby cool the inside of the box.

The refrigerant from the evaporator 31 returns to the compressor 21 of the heat exchange unit 12 via the refrigerant conduit 41 of the connection portion 14 and is compressed again. As described above, a refrigeration cycle for circulating the refrigerant is configured. Note that the reference numeral "26" denotes a vent provided in the casing of the heat exchange unit 12, "33" denotes an air inlet provided in the casing of the cooling unit 13. The power supply device 24 is provided below the compressor 21 provided on the heat exchange unit 12. This power supply device 24 may be a power source from an external power source, may be equipped with a battery, or may be a combination of both. On the heat exchange unit 12 side, a control operation unit 27 is provided. Electrical wires 42 for connecting the heat exchange unit 12 side and the cooling unit 13 side with respect to power and signals are arranged in the connection portion 14 in the same manner as in the refrigerant conduit 41.

The above-described example is a steam compressor, but it can be implemented by changing to other types of refrigerators, such as, e.g., an absorption-type refrigerator and a Sterling freezer, and it can be carried out using a corresponding refrigerant.

Connection Portion 14

The connection portion 14 may take a variety of configurations as long as the heat exchange unit 12 side and the cooling unit 13 side can be connected in terms of refrigerant conduits 41 and electrical wires 42. However, the connection portion 14 is preferably one having stiffness, intensity, and thermal insulation to a degree capable of supporting the heat exchange unit 12 and the cooling unit 13 in a manner hanging from the above.

Further, it is preferable that the heat exchange unit 12 and the cooling unit 13 have the same height. In other words, it is preferable to configure so as not to fall when placed on the floor or the like by removing from the heat insulation box 15 by equalizing the distance between the grounding portion of the lower end of the heat exchange unit 12 and the connection portion 14 and the distance between the grounding portion of the lower end of the cooling unit 13 and the connection portion 14. In cases where the height of the casing of the heat exchange unit 12 and that of the cooling unit 13 are different, it is preferable to configure so as not fall by providing a leg on the shorter side. It is most preferable that the operation can be made by turning on the power immediately after incorporating into the heat insulation box 15 without being tilted from the grounded state.

The refrigerant conduits 41 and the electrical wires 42 are accommodated in a groove formed on the lower surface side of the connection portion 14 and the groove is covered as required, so that the lower surface of the connection portion 14 is made substantially flat. Note that it may be configured such that the connection portion 14 is constituted by a cylindrical member such as a pipe and the refrigerant conduits 41 and the electrical wires 42 are accommodated therein. Further, the connection portion 14 may be configured by a plurality of rod-shaped frame members, and may be implemented by being changed to various configurations. The connection portion 14 may be divided into two or more parts, such as left and right parts.

The refrigerant conduit 41 may be implemented by arranging an insulation member as required. In particular, it is preferable that the connection portion 14 be constituted by a heat insulating plate having high mechanical strength and good heat insulating property made of a material of synthetic resin such as polypropylene or polyethylene which is foamed at a high density and the refrigerant conduits 41 are arranged inside the heat insulating plate. The connection plate 14 may be made of a foamed insulation material, such as, e.g., foamed urethane and foamed silicone. Further, it is appropriate to bury the refrigerant conduits 41 and the electrical wires 42 therein to insulate the sealed state without any gap in the final assembly stage.

Figure 2:
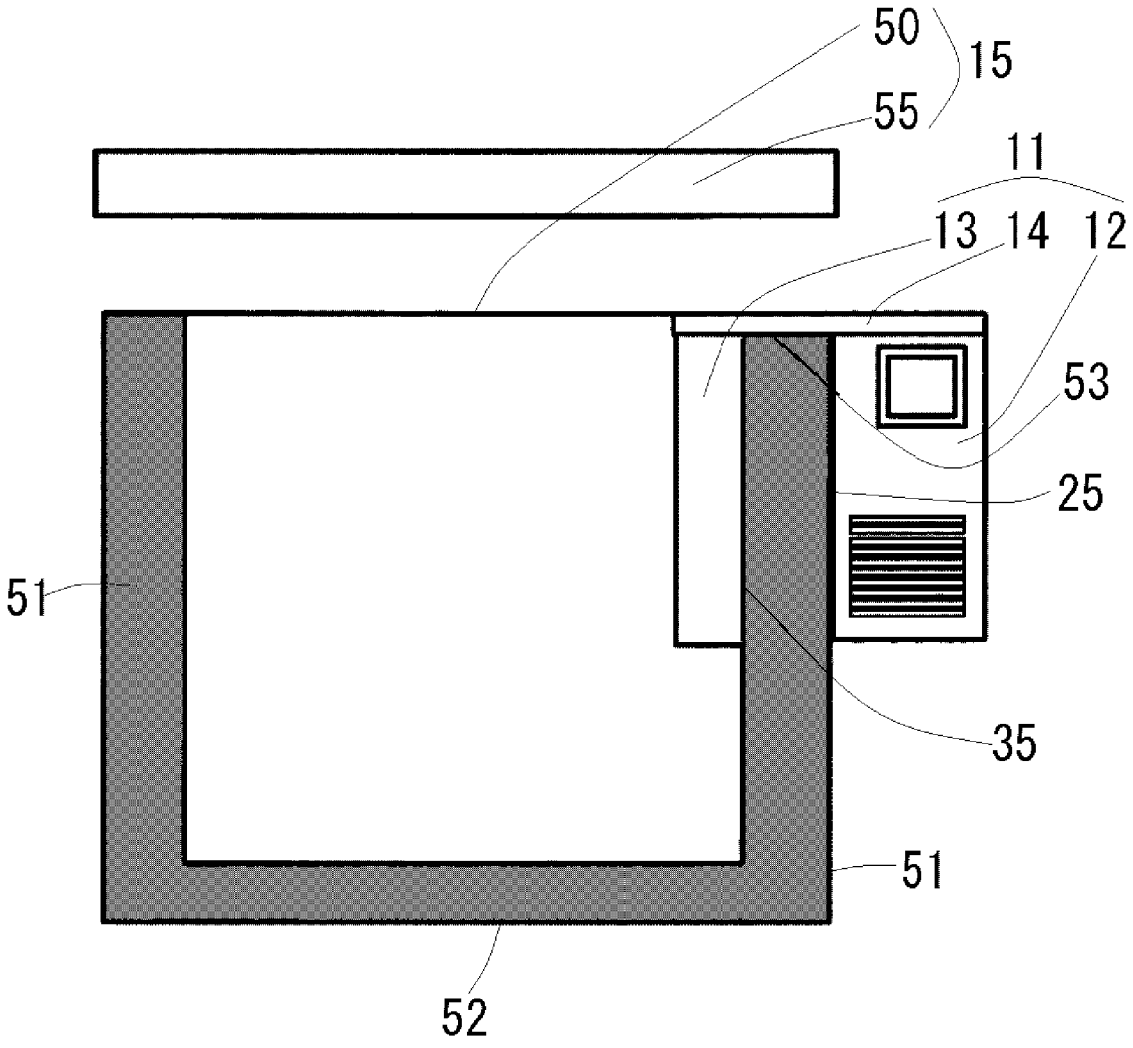
FIG. 2 is a cross-sectional view of the cooling system.
Figure 3:
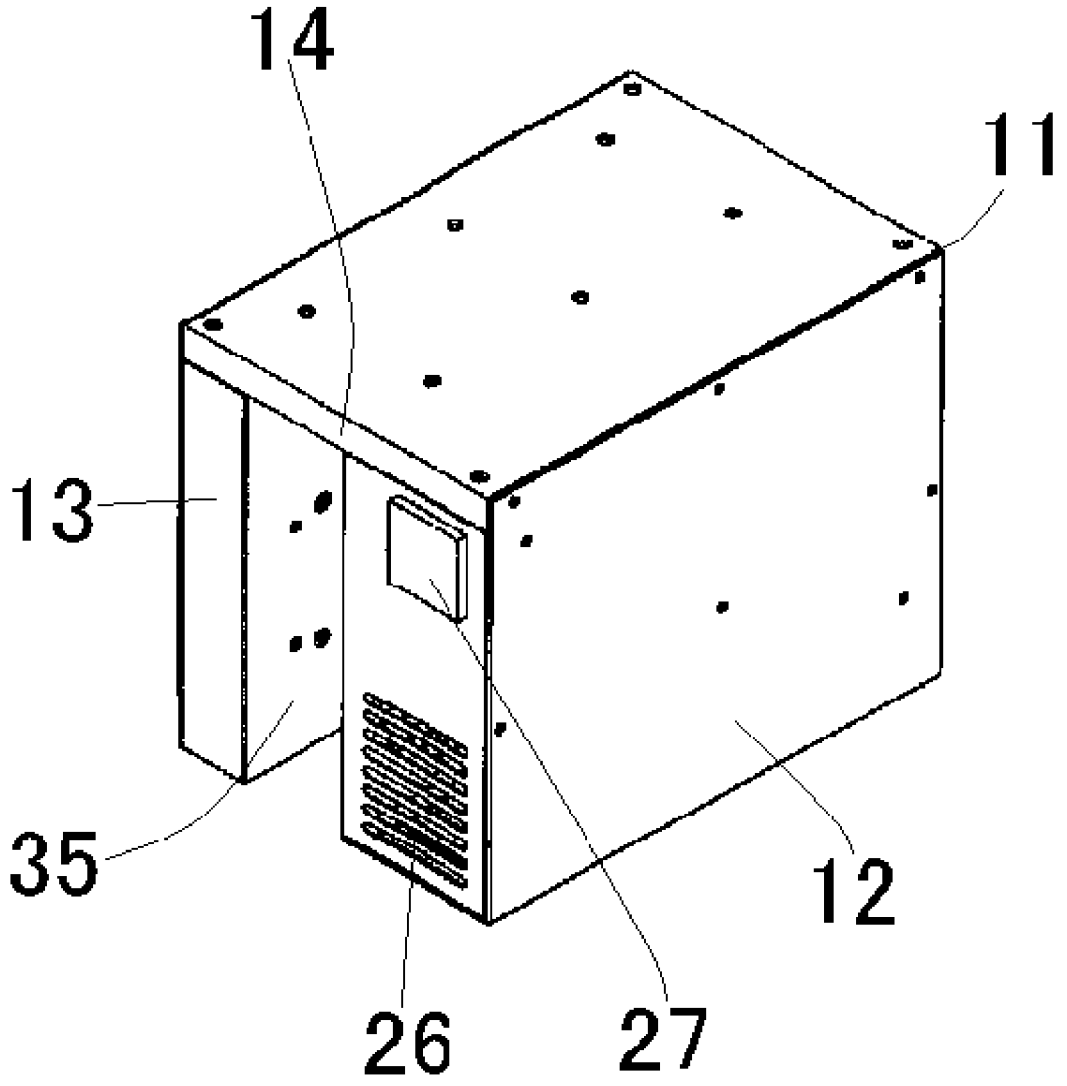
FIG. 3 is a perspective view of a cooling device as viewed from a heat exchange unit side of the cooling system.
Figure 4:
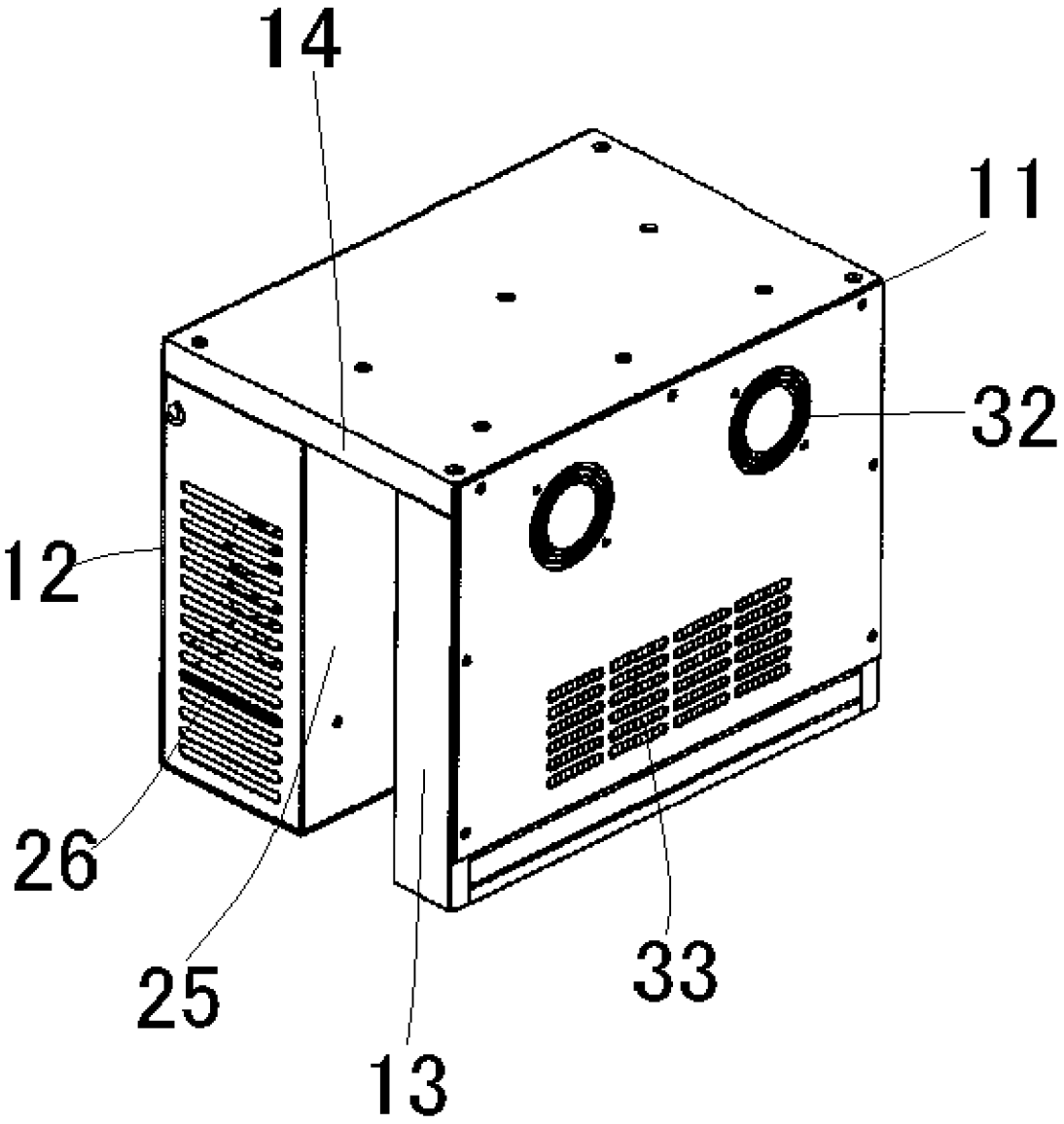
FIG. 4 is a perspective view of the cooling device as viewed from the cooling unit side of the cooling system.

As shown in FIG. 1 and FIG. 2, the connection portion 14 is arranged on the end portion of the sidewall 51 of the heat insulation box 15 in a straddling manner in a state in which the cooling unit 13 is arranged inside the heat insulation box 15 and the heat exchange unit 12 is arranged outside the heat insulation box 15. At this time, the connection portion 14 is placed on the upper end face of the sidewall 51 to support the entire load of the cooling device 11 by the connection portion 14.

The connection portion 14 performs the function of arranging the refrigerant conduits 41 and the electrical wires 42 therein and protecting them, the function of connecting the heat exchange unit 12 and the cooling unit 13 to form a single device, and the function of receiving the entire load when mounted on the heat insulation box 15, and connects the inner cooling space and the outside by penetrating the heat insulation box 15. Therefore, the cross-sectional area of the connection portion 14 is preferably as small as possible on the condition that it is possible to perform the respective functions described above. Therefore, when implementing the present invention, the width of the connection portion 14 can be set to be larger than the width of the heat exchange unit 12 and the cooling unit 13. In this embodiment, however, the width of the connection portion 14 is set to be equal to the width of the heat exchange unit 12 and the cooling unit 13. It is also desirable that the width of the connection portion 14 be set to be smaller than the width of the heat exchange unit 12 and the cooling unit 13. Further, it is desirable that the thickness of connection portion 14 be as small as possible, preferably 4 cm or less, more preferably 2 cm, but it should be noted that the present invention is not limited thereto.

Heat Insulation Box 15

The heat insulation box 15 is provided with a box body 50 including a plurality (four in this embodiment) of sidewalls 51 and a bottom 52 constituting the storage space of an item to be transported, and a lid 55 which is openably arranged on the opening of the box body 50. Insulators and other materials are arranged in each portion constituting the heat insulation box 15, and the heat insulation box functions as a heat insulation box when the cooling device 11 is not mounted. Specifically, as the heat insulating material of the heat insulation box 15, urethane foam, polypropylene foam, or the like, is used. In combination therewith, a vacuum insulation material may be used to improve the thermal insulation performance of the cover and the heat insulation box. In cases where the insulation wall is thin, the cooling device 11 may be mounted via a spacer.

The upper end of the sidewall 51 is provided with a recessed portion 53 for accommodating the connection portion 14 (see FIG. 2). Therefore, the cooling device 11 can be mounted on the heat insulation box 15 by simply lowering the cooling device 11 from above the sidewall 51 so that the connection portion 14 fits in the recessed portion 53 in a state in which the cooling unit 13 and the heat exchange unit 12 are arranged inside and outside, respectively. The removal can be easily completed by simply lifting the cooling device 11 upward. At this time, it is preferable that the distance between the opposed wall surface 25 of the heat exchange unit 12 and the opposed wall 35 of the cooling unit 13 be set to be substantially equal to the thickness of the sidewall 51 so that each of the opposed wall surface 25 of the heat exchange unit 12 and the opposed wall 35 of the cooling unit 13 each are in face-to-face contact with the inner and outer surfaces of the sidewall 51. With this, it is possible to suppress the leakage of the cooled air to the outside and to suppress the generation of rattling during the operation. However, in cases where the clearance is about 3 mm or less, the cooled air does not leak excessively, and therefore, the clearance can be considered to be closed with no gap. When the gap between the sidewall and the connection portion becomes a problem, the gap may be filled with a sealing material, such as, e.g., a closed-cell foam sheet and a nonwoven fabric, to ensure the airtightness. With this, the heat insulation effect can be improved and the inflow of the outside air can be shut off by the sealing effect. Therefore, it becomes hardly affected by the temperature change of the outside air and wasteful power will not be consumed, resulting in energy saving.

As described above, it is preferable that the cooling device 11 and the heat insulation box 15 be fixed only by fitting from the viewpoint of improving the workability. However, it is acceptable to adopt a structure that can be temporarily fixed with a fastening tool, such as, e.g., a clip-shaped fastener and a screw.

In the illustrated embodiment, the upper surface of the connection portion 14 and the upper end surface of the sidewall 51 are flush with each other. When the flat lid 55 is placed thereon, the storage space can be closed in a sealed state. However, it may be configured such that a recessed portion is formed on the box body 50 side and no recessed portion is formed on the sidewall 51 side, or such that a recessed portion is provided on both of them. In any event, it is preferable to configure such that the heat insulation box 15 can be closed by the lid 55 so as to maintain the sealed portion in a state in which the cooling device 11 is mounted on the heat insulation box 15.

Low-temperature Transportation

The above-described cooling device 11 and the heat insulation box 15 can be implemented as a low-temperature transportation system capable of delivering an item to be transported whose temperature control is crucial, such as, e.g., foods and chemicals, under proper temperature control and also capable of improving working conditions by reducing a burden on a deliverer.

Specifically, although not illustrated, delivery is performed by loading the cooling system in which the cooling device 11 is mounted on the heat insulation box 15 on a cargo bed of a delivery vehicle. At that time, the cooling device 11 is activated to cool the inside of the heat insulation box 15.

In the final stage of the delivery, the deliverer will carry the heat insulation box 15 to the destination. At that time, the cooling device 11 is removed and only the heat insulation box 15 and the item to be transported are delivered. This eliminates the need to carry the heavy cooling device 11, which in turn can reduce the burden on the deliverer. At that time, the recessed portion of the insulation wall for fitting the connection portion is sealed with a small lid made of insulation materials as a spacer to insulate it, thereby preventing the rising of the temperature in the box.

Figure 8:
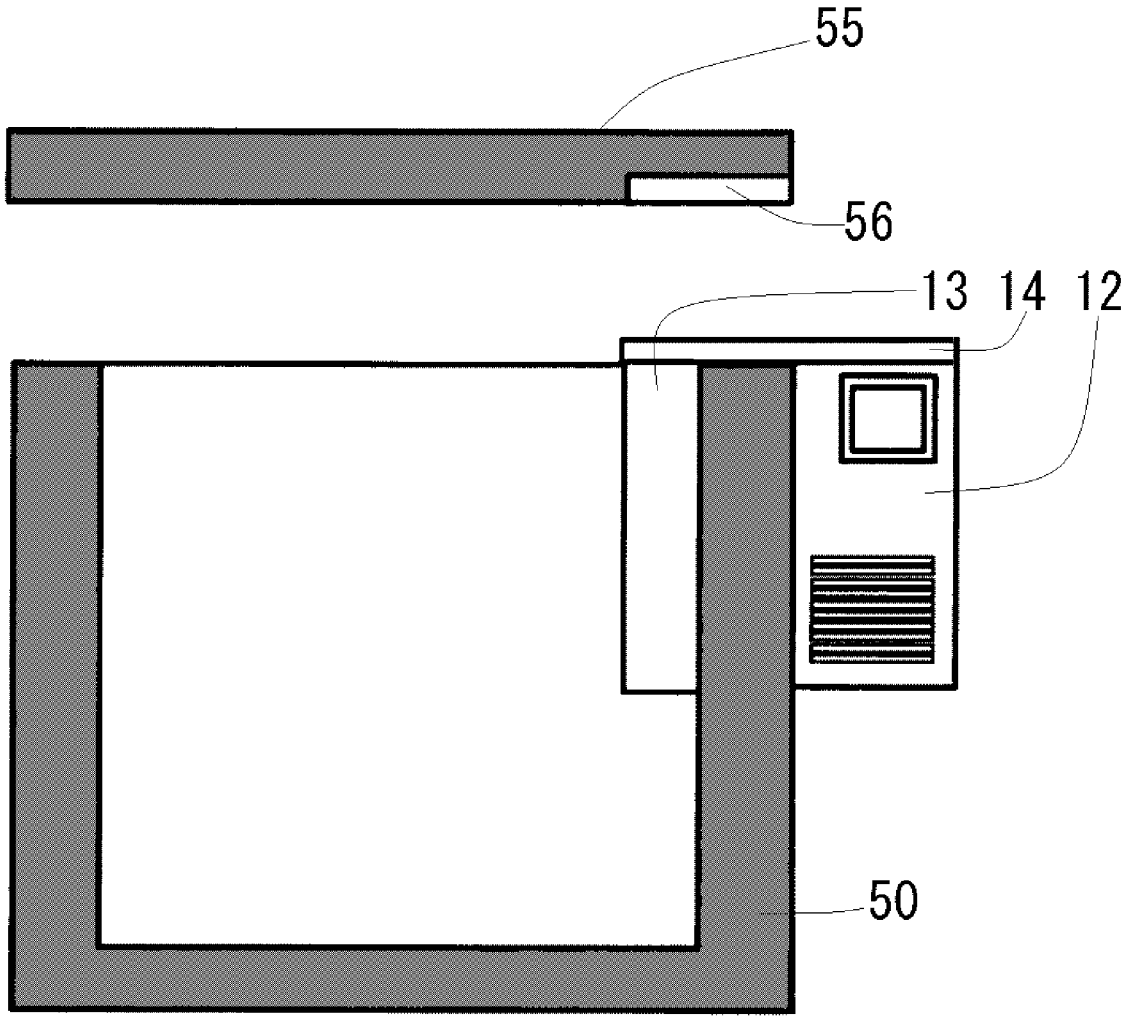
FIG. 8 is a cross-sectional view of a cooling system according to another embodiment of the present invention.

FIG. 8 shows another embodiment. A partial cutout 56 is formed in the lid 55 to avoid the interference with the connection portion 14. In this situation, there is no need to provide a recessed portion 53 in the heat insulation box 15. Note that when it is desired to use a normal product with no recessed portion or no cutout for the lid 55 and the heat insulation box 15, it can be implemented by mounting a spacer on the upper end surface of the heat insulation box 15.

Modifications

The present invention can be implemented by various modifications. For example, in the embodiment shown in the drawings, it has been described that the mounting of the cooling device 11 is performed vertically on the assumption that the opening of the heat insulation box 15 is located above. However, when the opening is located on the side, it may be implemented as performing the mounting operation of the cooling device 11 laterally. Although the lid 55 has been described as a flat lid, the configuration can be variously changed, such as a configuration with a step protruding downward in the same as in other heat insulation boxes. The lid 55 may be one attached to the box body 50 via a hinge. Although the delivery business including one using a foldable container is exemplified as the application, the present invention can be applied to various applications, such as, e.g., a cooler box for leisure and a storage/transportation box used inside or outside a business premise such as a factory.

Next, referring to FIG. 9 to FIG. 12, an embodiment of a clogging prevention mechanism of a capillary tube in a refrigeration cycle which can be applied to the implementation of the present invention will be described. Note that the clogging prevention mechanism of the capillary tube in the refrigeration cycle can be applied not only to the refrigeration system shown in FIG. 1 to FIG. 8 described above but also to other refrigeration cycles, such as, e.g., a refrigeration cycle in which a cooling unit and a heat exchange unit are integrated.

Overview of Refrigeration Cycle

Figure 9:
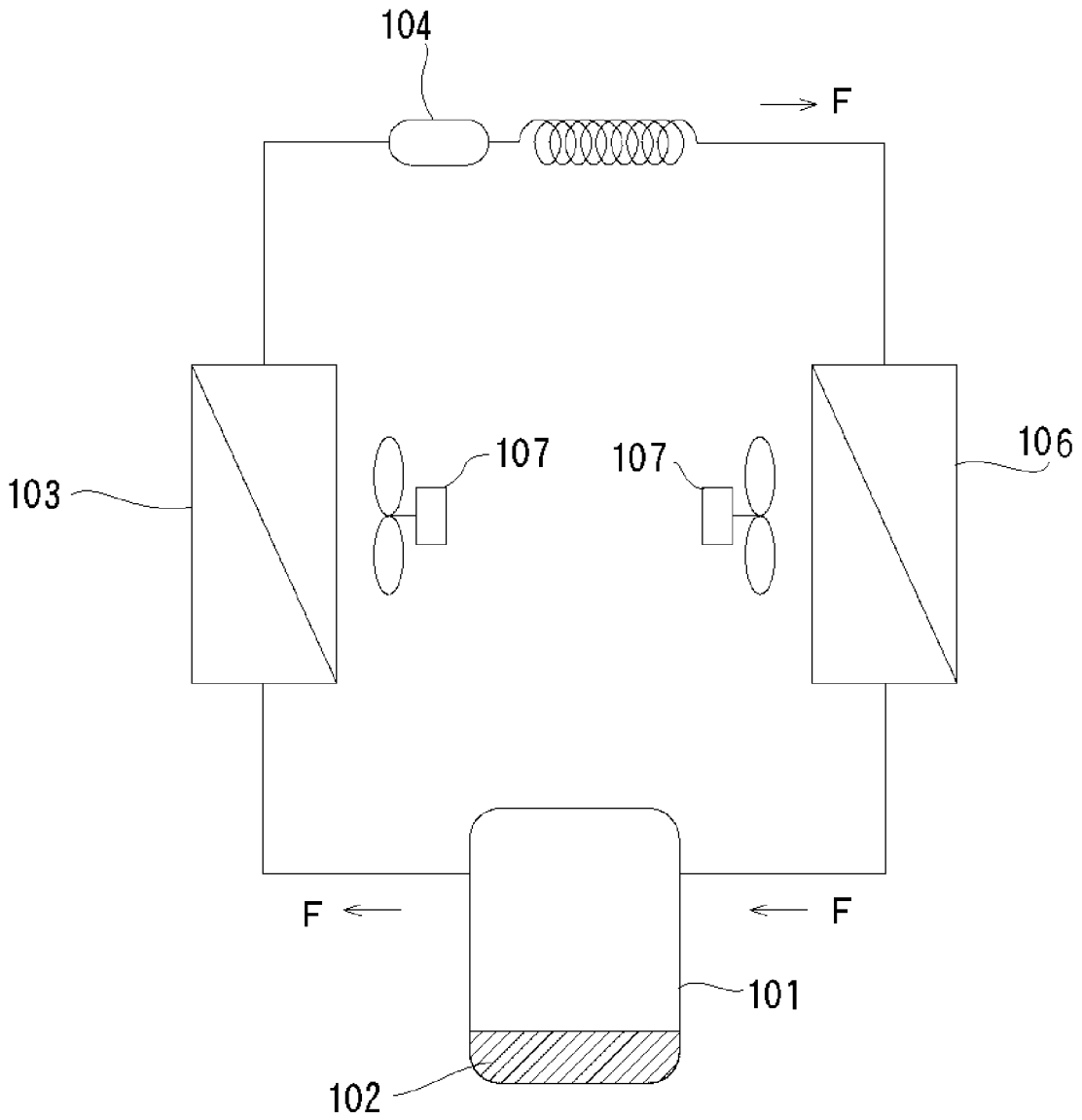
FIG. 9 is a circuit diagram showing an example of a refrigeration cycle of refrigerators/freezers applicable to the cooling system of the present invention.
Figure 10:
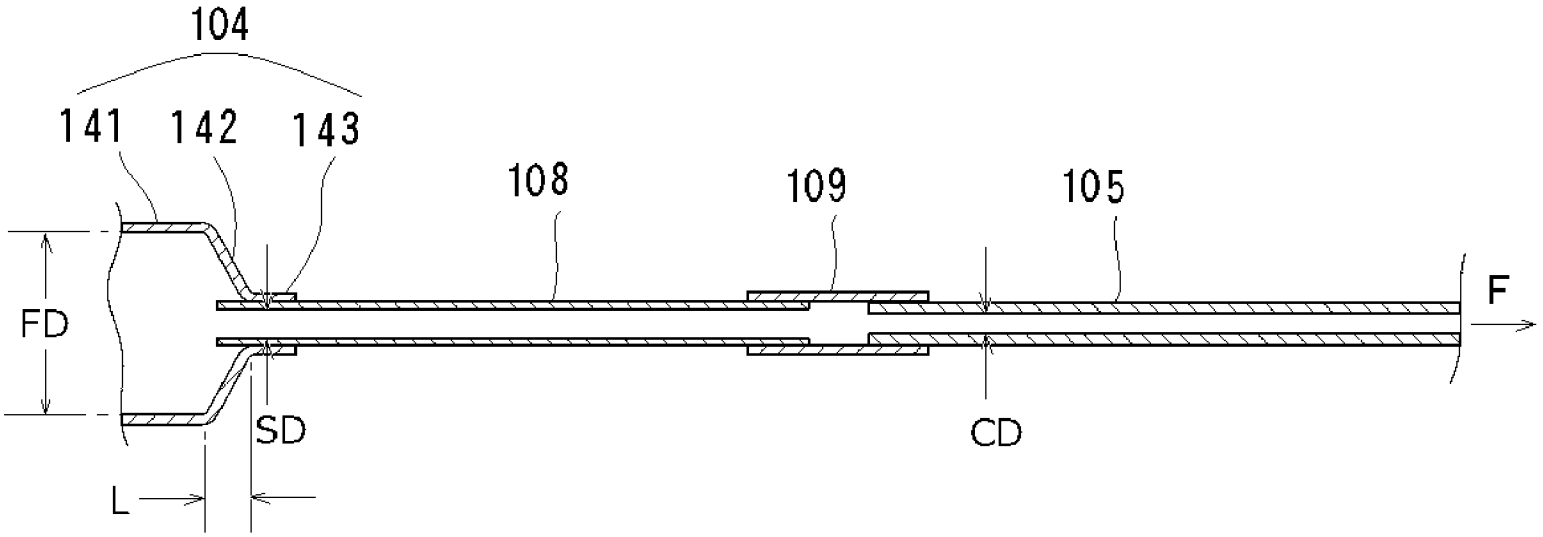
FIG. 10 is a cross-sectional view of a clogging prevention mechanism applicable to the cooling system according to an embodiment of the present invention.
Figure 11:
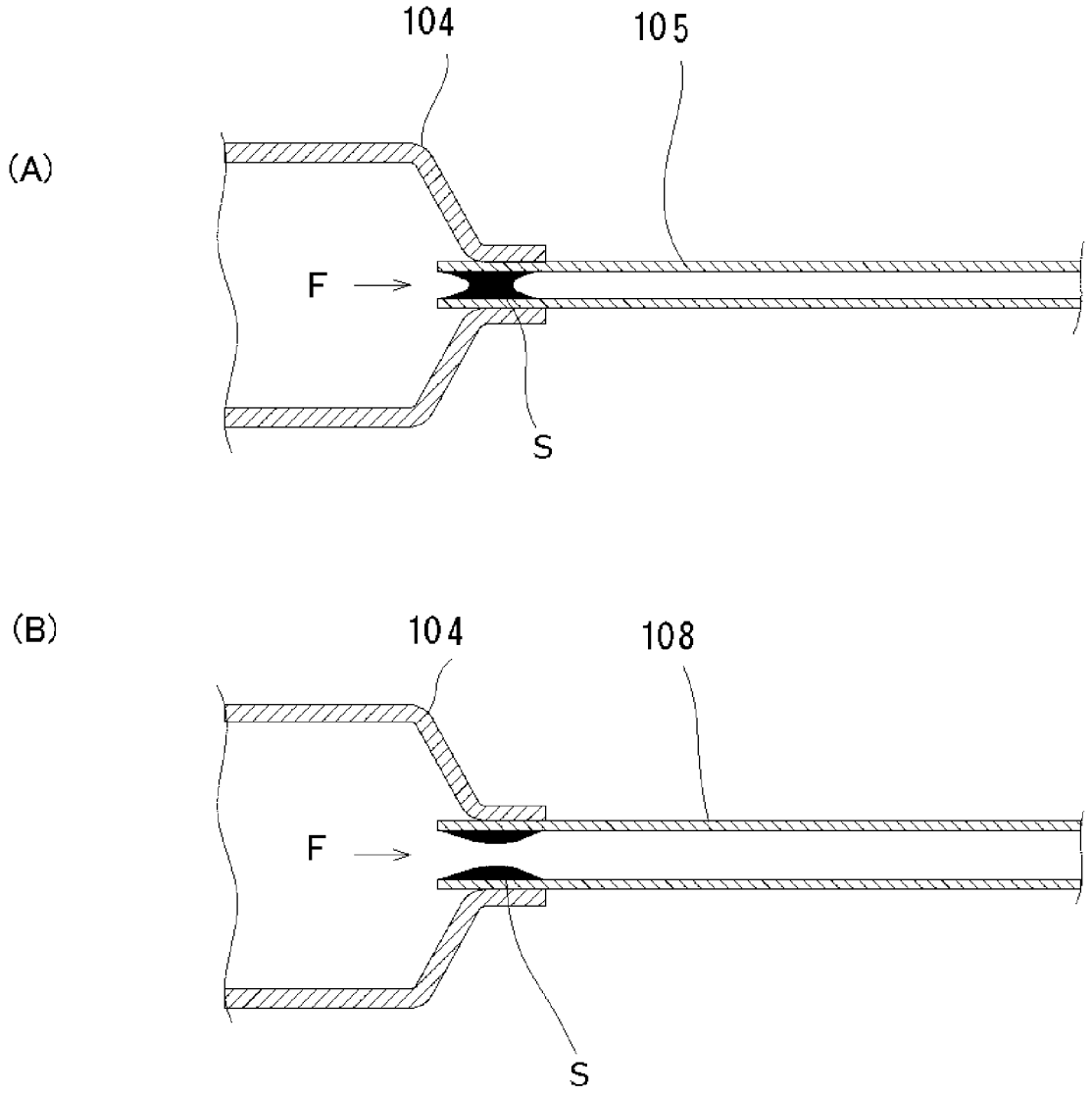
FIG. 11 shows comparative image diagrams of oil sludge adhesion at a capillary inlet of a conventional device and the present invention, where (A) is a conventional adhesion image and (B) is an adhesion image of the present invention.
Figure 12:
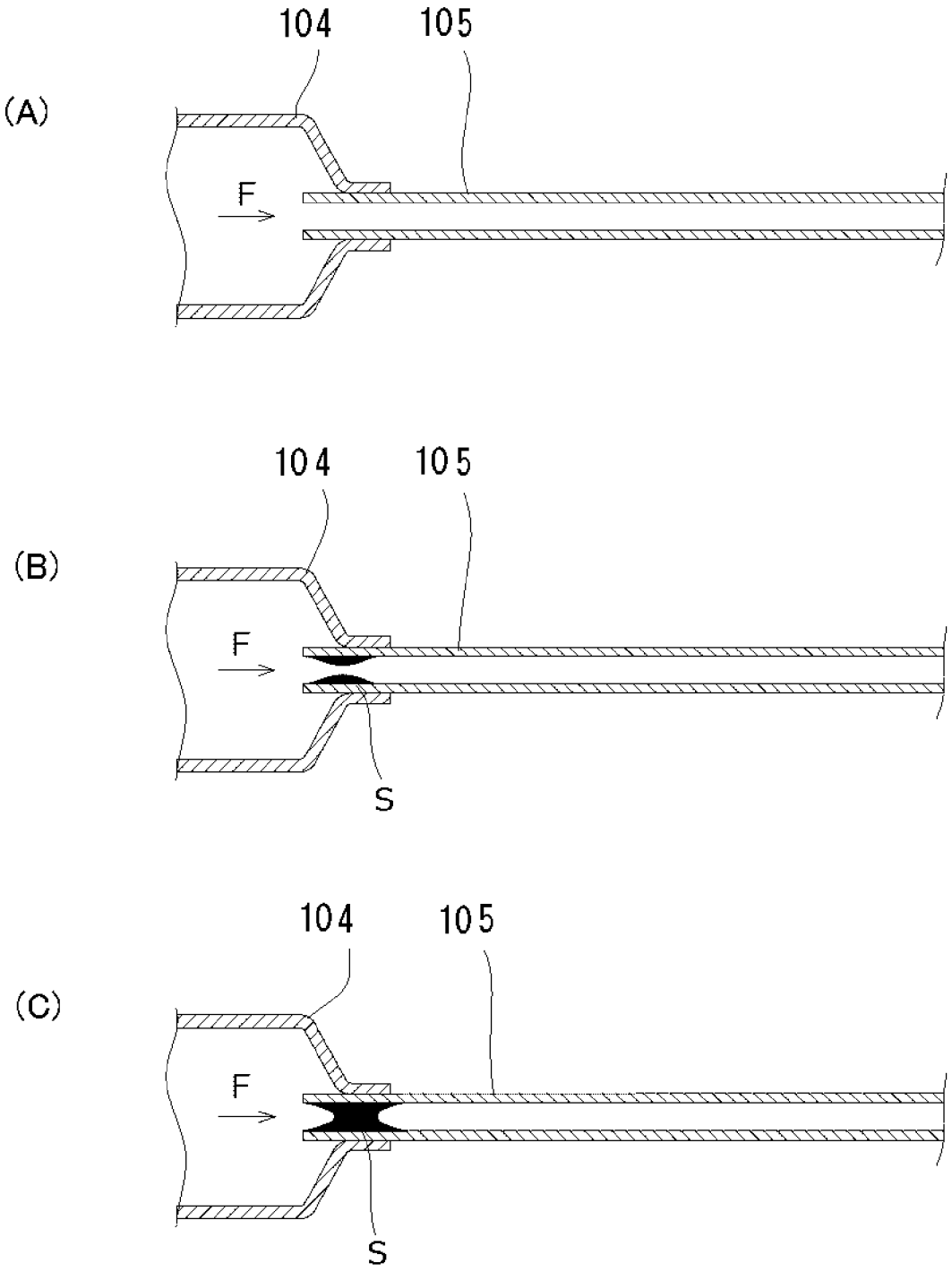
FIG. 12 is an image diagram of a clogged condition by oil sludge in the vicinity of an inlet portion of a conventional capillary tube.

First, referring to FIG. 9, an example of a refrigeration cycle of a refrigerator/freezer to which the clogging prevention mechanism of the present invention can be applied will be briefly described.

In this refrigeration cycle, a compressor 101, a condenser 103, and an evaporator 106 are connected annularly. Between the condenser 103 and the evaporator 106, a filter dryer 104 and a capillary tube 105 are arranged. A refrigerant circulates in the refrigeration cycle in the refrigerant flow direction indicated by the arrow F while changing the form between a gas state, a liquid state, and a gas-liquid mixture state to exchange heat. The high-temperature and high-pressure refrigerant gas discharged from the compressor 101 is liquefied by being cooled by the condenser 103, flows into the capillary tube 105 through the filter dryer 104 for removing moisture contents and foreign matters in the circuitry. The liquid refrigerant decompressed in the capillary tube 105 is evaporated in the evaporator 106 into a low-pressure gas and sucked by the compressor 101. By repeating this cycle, the condenser 103 becomes high in temperature and the evaporator 106 becomes low in temperature, so that cooling of a refrigerator or a freezer is performed.

The condenser 103 and the evaporator 106 are each provided with a fan 107 to perform the exhaust of warm air and blowing of cold air. In the compressor 101, there exists a refrigerating machine oil 102 for lubricating the inner mechanism, but this refrigerating machine oil 102 circulates in the circuit together with the refrigerant. As described above, the refrigerating machine oil 102 is exposed to high temperature and high pressure during the compressing process by the compressor 101 to be denatured into a tarry oil sludge by being mixed with fine metal powder and adheres to the inner wall of the capillary tube 105 in the vicinity of the inlet thereof where the pressure is rapidly reduced and the flow rate increases. In particular, in a relatively small refrigeration cycle (compressor power 500 W or less), the inner diameter of the capillary tube is generally as small as φ0.5 mm to 1.2 mm, and therefore there are some cases in which the adhesion amount increases with the operation time to finally cause clogging of the capillary tube, resulting in a failure of cooling.

Clogging Prevention Mechanism

The present invention provides a mechanism for preventing clogging of the capillary tube 105 in the refrigeration cycle. The structure will be described mainly referring to FIG. 10. In this embodiment, between the filter dryer 104 and the capillary tube 105 in the refrigeration cycle described above, a sub-capillary tube 108 having an inner diameter greater than the inner diameter of the capillary tube 105 is arranged. That is, the inner diameter SD of the inflow end of the sub-capillary tube 108 is set to be larger than the inner diameter CD of the inflow end of the capillary tube 105.

Specifically, the filter dryer 104 is provided with a body portion 141 whose inner diameter is approximately constant, a reduced diameter portion 142 formed at the outlet side of the body portion, and a joint portion 143 for joining the sub-capillary tube 108. In this embodiment, the structure is shown in which the sub-capillary tube 108 is inserted into the joint portion 143 and fixed thereto by welding, brazing, or the like. However, it may be configured such that the joint portion 143 is inserted into the inside of the sub-capillary tube 108, and other various modifications can be allowable.

The reduced diameter portion 142 is a portion where the inner diameter is narrowed down from the body portion 141 having an approximately constant inner diameter toward the joint portion 143. In the illustrative embodiment, the inflow end of the sub-capillary tube 108 is inserted into the inside of the reduced diameter portion 142, but it may be inserted so as to stop at the part of the joint portion 143.

The outflow end side of the sub-capillary tube 108 is connected to the inflow end side of the capillary tube 105 via a connection tube 109. In this embodiment, the sub-capillary tube 108 and the capillary tube 105 are substantially the same in outer diameter and different only in inner diameter, and therefore, a cylindrical member having a constant inner diameter is used for the connection tube 109. However, the sub-capillary tube 108 and the capillary tube 105 may be different in outer diameter. In this case, it is appropriate to use a cylindrical member having different inner diameters for the connection tube 109. The connection tube 109 may be fixed to the sub-capillary tube 108 and the capillary tube 105 by welding or brazing, but may be fixed by other fixing means. Further, the sub-capillary tube 108 and the capillary tube 105 may be fixed in a butt state or inserted state.

Details of Clogging Prevention Mechanism

As noted above, the present invention is effective in preventing clogging by oil sludge, which is remarkably apparent in a thin capillary tube, and therefore, it is advantageous to apply the present invention to a capillary tube 105 having an inflow end inner diameter CD of 0.5 mm to 1.2 mm. Considering that it is advantageous that the length can be reduced when the inner diameter is shorter provided that the flow resistance caused by the capillary tube 105 is the same, it is more desirable that the inflow end inner diameter CD of the capillary tube 105 be 1.0 mm or less. It is advantageous to apply the present invention to the case in which the inner diameter FD of the body portion 141 of the filter dryer 104 is 15 mm to 30 mm and the inner diameter CD of the inflow end of the capillary tube 105 is 0.5 mm to 1.2 mm.

Here, the inner diameter SD of the inflow end of the sub-capillary tube 108 requires to be larger than the inner diameter CD of the inflow end of the capillary tube 105, but since the sub-capillary tube 108 must not be clogged, the inner diameter SD of the inflow end of the sub-capillary tube 108 also needs to be larger than 0.7 mm, more preferably larger than 0.9 mm.

Particularly, it is preferable that the opening area of the inner space of the sub-capillary tube 108 be set to be approximately twice or more than the opening area of the inner space of the capillary tube 105 by providing a difference in the flow path area therebetween in order to realize a structure in which oil sludge mainly adheres to the inlet portion of the sub-capillary tube 108 and hardly adheres to the inlet portion of the capillary tube 105. Therefore, it is desirable that the inner diameter SD of the inflow end of the sub-capillary tube 108 be equal to or greater than about 1.4 times the inner diameter CD of the inflow end of the capillary tube 105.

Further, since the oil sludge adheres to a range of several centimeters in the vicinity of the inlet portion, from the viewpoint of sacrificially making oil sludge adhere to the sub-capillary tube 108, it is preferable that the length of the sub-capillary tube 108 be 3 cm or more, and it sufficient that it is 5 cm or more. Therefore, from this viewpoint, the length of the sub-capillary tube 108 may be made extremely long. However, the material cost and space are only wasted even if it is set to be long. For this reason, considering the workability such as welding, it is practically advantageous that the length is set to about 10 cm or more and about 30 cm or less.

The present invention controls the adhesion of the oil sludge to the capillary tube 105 by sacrificially making oil sludge adhere to the sub-capillary tube 108. Therefore, at the joint portion of the filter dryer 104 and the sub-capillary tube 108, it is appropriate that the length L of the reduced diameter portion 142 of the filter dryer 104 is twice or less than the inner diameter FD of the body portion 141 of the filter dryer 104, and it is more preferable that the length L be equal to or less than the inner diameter FD. However, this does not preclude that the length of the reduced diameter portion 142 is increased and the inner diameter of the reduced diameter portion 142 is gradually reduced. Further note that although the illustrative embodiment is described in which the inner diameter of the capillary tube 105 is constant in the drawing, it does not preclude that the inner diameter of the capillary tube 105 may be gradually decreased toward the outlet.

As described above, conventionally, oil sludge S adheres to the capillary tube 105 having a small inner diameter and the flow path is clogged (see FIG. 11(A)) at the connecting part between the filter dryer 104 and the capillary tube 105. However, the present invention can provide a clogging prevention mechanism of a capillary tube capable of controlling the adhesion of the oil sludge S in the capillary tube 105 by making the oil sludge S adhere the sub-capillary tube 108 having a larger inner diameter to prevent clogging of the flow path (see FIG. 11(B)).

DESCRIPTION OF SYMBOLS

11: Cooling device
12: Heat exchange unit
13: Cooling unit
14: Connection portion
15: Heat insulation box
21: Compressor
22: Condenser
23: Condensing fan
24: Power supply device
25: Opposed wall surface
27: Control operation unit
31: Evaporator
32: Cooling fan
33: Temperature sensor
35: Opposed wall
41: Refrigerant conduit
42: Electrical wire
50: Box body
51: Sidewall
52: Bottom
53: Recessed portion
55: Lid
56: Cutout
101: Compressor
102: Refrigerating machine oil
103: Condenser
104: Filter dryer
105: Capillary tube
106: Evaporator
108: Sub-capillary tube
109: Connection tube
141: Body portion of filter dryer
142: Reduced diameter portion of filter dryer
143: Joint portion of filter dryer
CD: Inner diameter of inflow end of capillary tube 105
FD: Inner diameter of body portion 141 of filter dryer 104
SD: Inner diameter of inflow end of sub-capillary tube 108
L: Reduced diameter portion 142 length
S: Oil sludge

The invention claimed is:

1. A cooling system comprising:
a heat insulation box with a lid; and
a cooling device having a refrigeration cycle,
wherein the cooling device is provided with a cooling unit arranged inside the heat insulation box with the lid and a heat exchange unit arranged outside the heat insulation box with the lid,
wherein a connection portion connecting the cooling unit and the heat exchange unit is sandwiched between the lid and a heat insulation box body of the heat insulation box with the lid, and
wherein a refrigerant is configured to circulate between the cooling unit and the heat exchange unit via the connection portion to cool an inside of the heat insulation box with the lid,
wherein the connection portion accommodates a refrigerant conduit and an electrical wire therein to connect between the cooling unit and the heat exchange unit and wherein the connection portion is configured to support the heat exchange unit and the cooling unit in a manner to hang from the heat insulation box,
such that the connection portion is arranged to engage an end portion of a sidewall of the heat insulation box in a straddling manner and is configured such that an entire load of the cooling device is supported by the connection portion.

2. The cooling system as recited in claim 1, wherein the cooling device is configured such that the cooling unit and the heat exchange unit are connected by the connection portion,
wherein the cooling unit is provided with a temperature sensor for detecting a temperature in the heat insulation box and a fan motor for sending a cooled air for cooling into the heat insulation box,
wherein the connection portion is composed of a connection plate in which piping for the refrigerant and wiring of the temperature sensor and the fan motor are laid therein,
wherein the cooling device is configured to be detachable from the heat insulation box,
wherein a distance between a portion of a lower end of the heat exchange unit and the connection portion and a distance between a portion of a lower end of the cooling unit and the connection portion are equal.

3. The cooling system as recited in claim 2, wherein, when the cooling device is removed from the heat insulation box with the lid and is placed on a surface, the lower end of the heat exchange unit and the lower end of the cooling unit are level so that the cooling device does not fall.

4. A cooling system for low-temperature transportation,
wherein the cooling system as recited in claim 1 is arranged on a cargo bed of a delivery vehicle for physical distribution,
wherein during delivery, the cooling unit performs cooling of an inside of the heat insulation box, and
wherein when carrying out an item to be transported outside the delivery vehicle, it is configured to be able to lightly transport only the heat insulation box with the lid from which the cooling unit, the heat exchange unit, and the connection portion have been removed and the item to be transported.

5. The cooling system as recited in claim 1,
wherein a sub-capillary tube having an inner diameter larger than an inner diameter of a capillary tube is arranged between a filter dryer and the capillary tube in the refrigeration cycle of the cooling device,
wherein an inner diameter SD of an inflow end of the sub-capillary tube is larger than an inner diameter CD of an inflow end of the capillary tube,
wherein an inner diameter FD of a body portion of the filter dryer is 15 mm to 30 mm,
wherein the inner diameter CD of the inflow end of the capillary tube is 0.5 mm to 1.2 mm, and wherein the inner diameter SD of the inflow end of the sub-capillary tube is larger than 0.7 mm.

6. The cooling system as recited in claim 5, wherein an opening area of an inner space of the inflow end of the sub-capillary tube is twice or more than an opening area of an inner space of the inflow end of the capillary tube.

7. The cooling system as recited in claim 6, wherein the filter dryer is provided with the body portion, a joint portion for the sub-capillary tube, and a reduced diameter portion ranging from an outflow end of the body portion of the filter dryer to the reduced diameter of the joint portion, and wherein when a length of the reduced diameter portion is L, the following relation is satisfied:

$L<2FD$.

* * * * *